US006315846B1

(12) United States Patent
Hibner et al.

(10) Patent No.: US 6,315,846 B1
(45) Date of Patent: Nov. 13, 2001

(54) HEAT TREATMENT FOR NICKEL-BASE ALLOYS

(75) Inventors: Edward Lee Hibner, Ona; Sarwan Kumar Mannan, Barboursville, both of WV (US)

(73) Assignee: Inco Alloys International, Inc., Huntington, WV (US)

( * ) Notice: Subject to any disclaimer, the term of this patent is extended or adjusted under 35 U.S.C. 154(b) by 0 days.

(21) Appl. No.: 09/517,242

(22) Filed: Mar. 2, 2000

Related U.S. Application Data

(63) Continuation-in-part of application No. 09/112,418, filed on Jul. 9, 1998, now abandoned.

(51) Int. Cl.[7] ..... C22F 1/10
(52) U.S. Cl. ..... 148/675; 148/677
(58) Field of Search ..... 148/675, 676, 148/677

(56) References Cited

U.S. PATENT DOCUMENTS

| | | | |
|---|---|---|---|
| 3,046,108 | 7/1962 | Eiselstein | 75/171 |
| 3,871,928 | 3/1975 | Smith, Jr. et al. | 148/142 |
| 4,750,950 | 6/1988 | Clatworthy et al. | 148/158 |
| 4,788,036 | 11/1988 | Eiselstein et al. | 420/448 |
| 4,979,995 | 12/1990 | Hattori et al. | 148/2 |
| 5,059,257 | 10/1991 | Wanner et al. | 148/12.3 |
| 5,244,515 | 9/1993 | Miglin | 148/675 |
| 5,556,594 | 9/1996 | Frank et al. | 420/448 |

FOREIGN PATENT DOCUMENTS 2202331 10/1997 (CA) .

OTHER PUBLICATIONS

Alloy Digest, "Custom Age 625 Plus Alloy," Jul. 1988, 1 p.
Alloy Digest, "Inconel Alloy 725," Jan. 1994, 3 pp.

*Primary Examiner*—John Sheehan
(74) *Attorney, Agent, or Firm*—Robert F. Dropkin, Esq.; Webb Ziesenheim Logsdon Orkin & Hanson, P.C.

(57) ABSTRACT

A heat treatment for hot or cold worked 725 corrosion resistant Ni-base alloys to increase the room temperature yield strength of the material to above about 140 ksi (965 MPa). The material is useful for oil patch and gas turbine applications. The process includes annealing the material at about 1825° F. (996° C.) for about 1.5–4 hours, age hardening the material at about 1400° F. (760° C.) for about 3.0 to 10.5 hours to precipitate double gamma prime, furnace cooling the material about 50° F. (28° C.) to 100° F. (56° C.) per hour and heat treating the material at about 1200° F. (649° C.) for about 4.0 to about 12.5 hours.

10 Claims, 3 Drawing Sheets

Figure 3 -75F Charpy-V-Notch Impact Strength as a Function of Time at Temperature During Annealing at 1825F, Prior to Aging at 1400F/6h, FC, 1200F/6h/AC
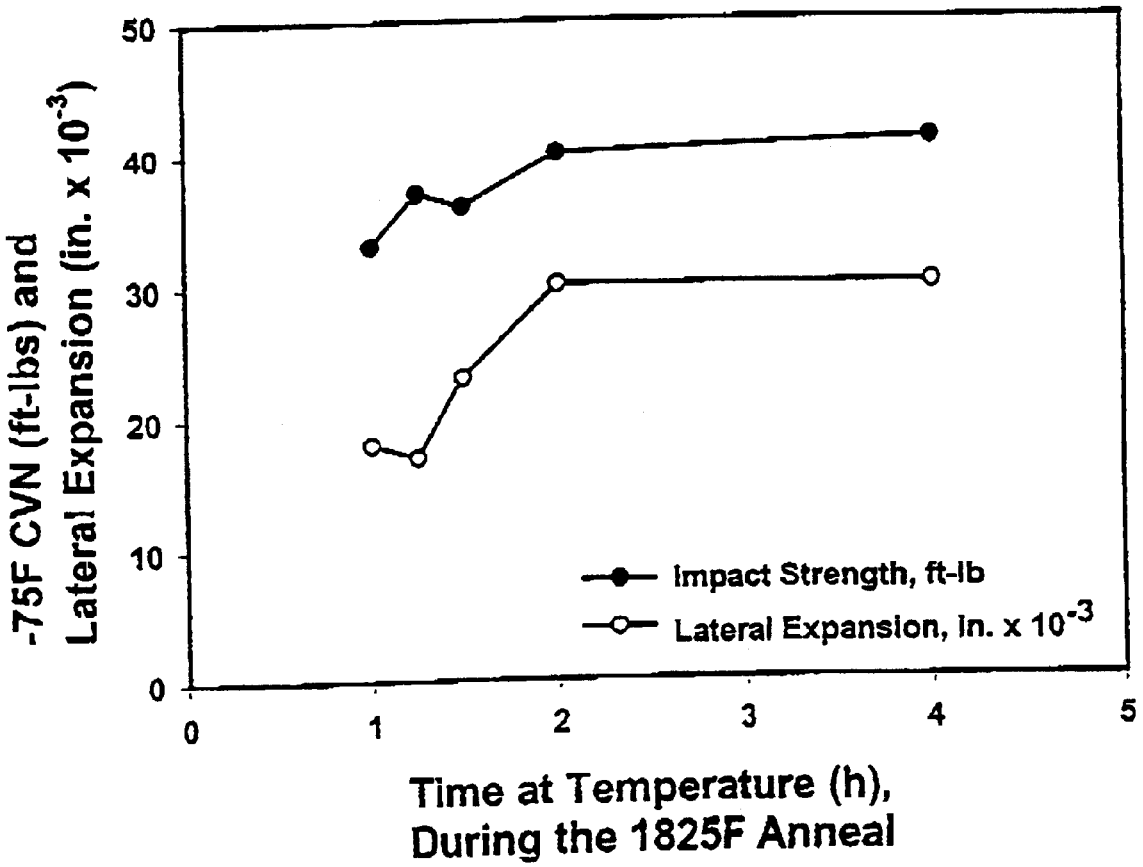

HEAT TREATMENT FOR NICKEL-BASE ALLOYS

RELATED APPLICATION

This application is a continuation-in-part of U.S. application Ser. No. 09/112,418 entitled "Heat Treatment for Nickel-Base Alloys" filed Jul. 9, 1998, now abandoned.

TECHNICAL FIELD

The instant invention relates to corrosion resistant nickel-base alloys in general, and more particularly, to a heat treatment that encourages gamma prime and double gamma prime precipitation and relatively high yield strengths on the order of 156–172 ksi (1076–1186 MPa) as well as low temperature fracture toughness and ductility.

BACKGROUND ART

In physically and chemically demanding environments, such as oil patch and gas turbine applications, there is a need for higher strength nickel-base alloys having corrosion resistance greater than the workhorse 3% molybdenum precipitation hardened alloys—INCONEL® alloy 718 (UNS N07718) and INCOLOY® alloy 925 (UNS N09925). In particular, a yield strength in the range of about 140–170 ksi (965–1172 MPa) combined with superior corrosion resistance is desired by fabricators and component manufacturers. The "UNS" prefix and the "UNS" numbers set forth herein refer to the alloy compositions in the well-known "Unified Numbering System" established by SAE HS-1086 and ASTM DS-566.

Oil patch applications include subsurface and well head completions and drill components. High strength and corrosion resistant containment rings and associated components on gas turbine engines require lightweight but robust construction.

Age hardenable alloys based upon nickel and containing precipitation hardening amounts of titanium, niobium and/or aluminum have been known and used for many years. Various heat treatment techniques have been employed to obtain desired physical and chemical characteristics. See, for example, U.S. Pat. No. 3,871,928.

More particularly, component fabricators and designers have identified the following characteristics and targets as desirable for specific oil/gas and turbine applications:

(1) Age-hardenable yield strength ≧140 ksi (968 MPa);

(2) Low temperature Charpy V-notch impact strength at −75° F. (−58° C.)=25 ft-lbs (111 N-m);

(3) Pitting resistance superior to alloy 718 (UNS N07718) and alloy 925 (UNS N09925);

(4) Resistance to hydrogen embrittlement per NACE TM-0177 test;

(5) Stress corrosion cracking resistance to moderately sour oil field environments at temperatures from 250° to 350° F. (121° to 177° C.);

(6) Fracture energy as expressed by tensile strength elongation greater than exhibited by alloy 718 (UNS N07718); and (7) High temperature strength greater than exhibited by alloy 625 (UNS N07716).

The typical commercial compositions of alloy 725 (UNS N07725) and alloy 625 (UNS N07716) are given in Table 1 below:

TABLE 1

Chemical Composition (wt. %)

| | Alloy 725 (UNS N07725) | Alloy 625 (UNS N07716) |
|---|---|---|
| Nickel | 55.0–59.0 | 57.0–63.0 |
| Chromium | 19.0–22.5 | 19.0–22.0 |
| Molybdenum | 7.0–9.5 | 7.0–9.5 |
| Niobium | 2.75–4.0 | 2.75–4.0 |
| Titanium | 1.0–1.7 | 1.0–1.6 |
| Aluminum | 0.35 max. | 0.35 max. |
| Carbon | 0.03 max. | 0.20 max. |
| Manganese | 0.35 max. | 0.20 max. |
| Silicon | 0.20 max. | 0.20 max. |
| Phosphorus | 0.015 max. | 0.015 max. |
| Sulfur | 0.010 max. | 0.010 max. |
| Commercial Impurities | Trace | Trace |
| Iron | Remainder | Remainder |

Alloy 725 (UNS N07725) is strengthened by precipitation of double gamma prime phase during an aging treatment. Before aging, the alloy is currently solution annealed at 1900° F. (1040° C.) and air cooled or water quenched. For sour gas applications, the published recommended aging treatment is 1350° F. (730° C.)/8hours, furnace cooled and then air cooling.

In summary, in order to obtain the published high yield strength for, say, age hardened rounds (133 ksi (917 MPa)) or strip (143 ksi (992 MPa)), the current practice is to anneal, cold work and then age.

In order to exceed the properties of alloys 718 and 925, it was contemplated that a new heat treatment paradigm would be necessary.

SUMMARY OF THE INVENTION

Accordingly, there is provided a heat treatment for 725 type alloys (alloys N07725 and N07716).

In contrast to current practice, the heat treatment is performed directly on hot or cold worked material, hereinafter referred to as "worked material".

The heat treatment of the present invention consists of an initial anneal on the worked material of about 1825° F. (996 ° C.)±25° F. (14° C.) for at least about 1.5 to 4.0 hours, followed by age hardening at about 1400° F. (760° C.)±50° F. (28° C.) for about 3.0 to 10.5 hours, followed by furnace cooling at about 50° F. (28° C.)±25° F. (14° C.) per hour to about 100° F. (56° C.)±25 ° F. (14° C.) per hour and finally heat treating the alloy at about 1200° F. (649° C.)±50° F. (28° C.) for about 4.0 to 12.5 hours.

The resultant room temperature 0.2% yield strength of the alloy is in excess of about 140 ksi (986 MPa), preferably above 150 ksi (1042 MPa); and more preferably in excess of 155 ksi (1069 MPa). The low temperature impact strength properties at −75° F. (−58° C.) are dramatically improved by the heat treatment of the present invention, exhibiting Charpy V-notch values greater than 25 ft-lbs (111 N-m).

BRIEF DESCRIPTION OF THE DRAWINGS

FIG. 3 shows the impact of annealing time on low temperature properties.

PREFERRED EMBODIMENT OF THE INVENTION

Figure 1:
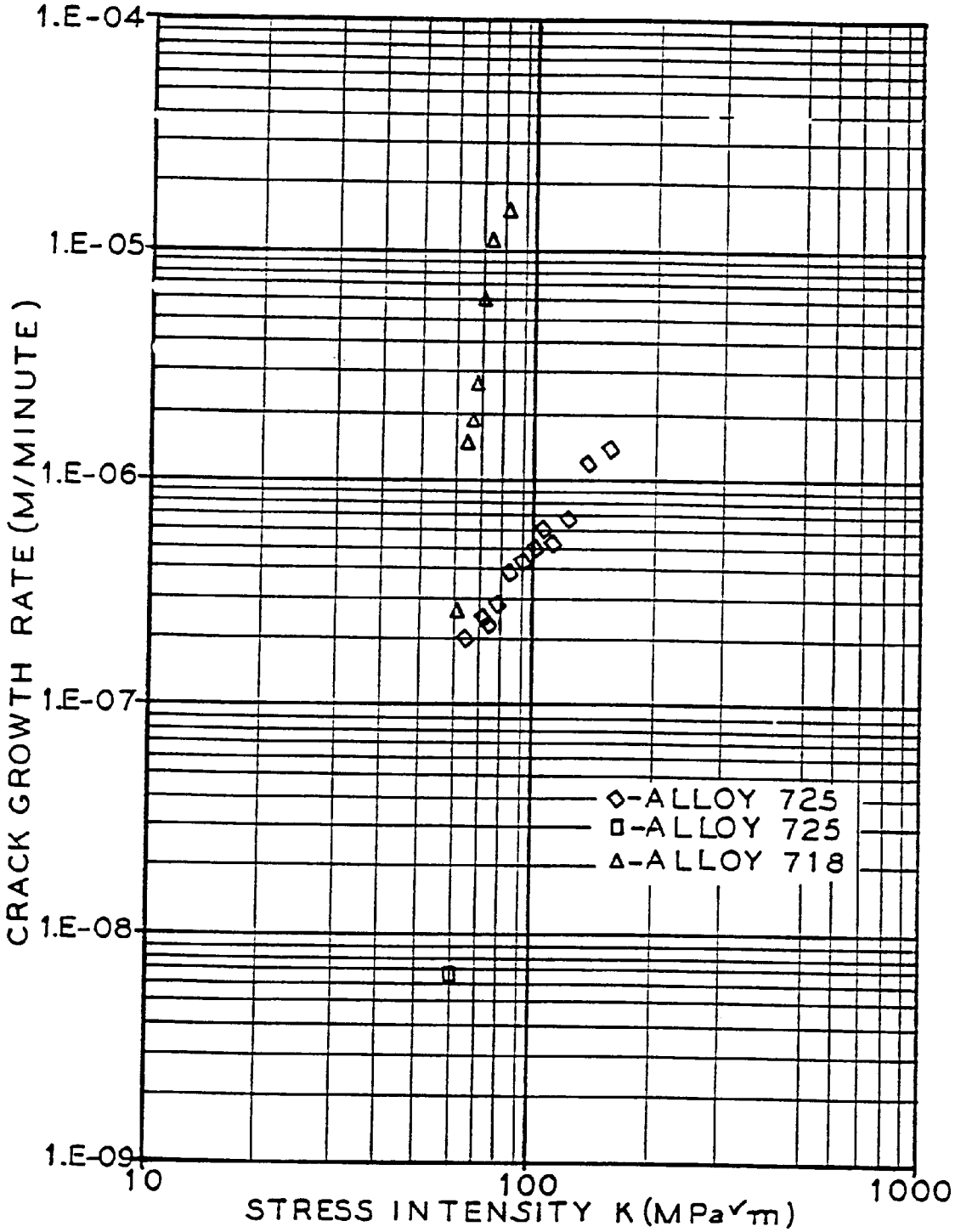
FIG. 1 compares static crack growth data for alloy 725 and alloy 718 at 538° C. (1000° F.) in air.

For the purposes of this specification, the appearance of the adverb "about" before a single or series of values shall be interpreted to encompass each and every value unless expressly indicated to the contrary.

Although the inventors have endeavored to accurately convert units and measurements, in the event a discrepancy exists between an English unit of measurement and an SI unit of measurement, the English unit of measurement shall be controlling.

The instant heat treatment process is applicable to 725 type alloys, hereinafter sometimes referred to as a nickel-base "modified 725 alloy" or merely as "a Ni-base alloy", such as UNS designations N07725 and N07716. A typical nominal composition for one such nickel base alloy (alloy 625) is set forth in Table 2.

TABLE 2

| | Nom. Alloy 625 (N07716) |
|---|---|
| Ni | 61 |
| Cr | 20.5 |
| Mo | 8.5 |
| Nb | 3.3 |
| Ti | 1.3 |
| Al | 0.2 |
| C | 0.015 |
| Mn | 0.1 |
| Si | 0.1 |
| P | 0.005 |
| S | 0.002 |
| Commercial Impurities | Trace |
| Fe | Remainder |

The expression "725 alloy" or "Ni-base alloy" as used herein encompasses the approximate ranges of UNS N07725 and N07716. Accordingly, for this specification and claims, a modified "725 alloy" or "Ni-base alloy" may include the broad approximate lower and upper ranges of the identified component elements and/or the particular composition, identified in the UNS numbers N07725 and N07716 and/or the particular examples disclosed therein set forth in Tables 1–3. The broad composition range of UNS N07725 and UNS N07716 as derived from Table 1 is set forth below in Table 3.

TABLE 3

| Broad Range For Modified 725 Alloy | |
|---|---|
| Element | wt. % |
| Ni | 55–63 |
| Cr | 19–22.5 |
| Mo | 7–9.5 |
| Nb | 2.75–4 |
| Ti | 1–1.7 |
| Al | 0.35 max. |
| C | 0.03 max. |
| Mn | 0.35 max. |
| Si | 0.2 max. |
| P | 0.15 max. |

TABLE 3-continued

| Broad Range For Modified 725 Alloy | |
|---|---|
| Element | wt. % |
| S | 0.01 max. |
| Commercial Impurities | Trace |
| Fe | Remainder |

In general, the worked alloy is initially (a) annealed at about 1825° F. (996° C.)±25° F. (14° C.) for over one hour, preferably for at least about 1.5 to 2 hours and longer, and more preferably, for about 2 to 4 hours; (b) followed by age hardening at about 1400° F. (760° C.)±50° F. (28° C.) for about 3.0 to 10.5 hours; (c) followed by furnace cooling at about 50° F. (90° C.)±25° F. (14° C.) per hour to about 100° F. (180° C.)±25° F. (14° C.) per hour; and (d) finally heat treating at about 1200 ° F. (649° C.)±50° F. (28° C.) for about 4.0 to 12.5 hours.

The resultant mechanical properties of an alloy 725 bar heat treated pursuant to the process disclosed herein as listed below:

| 0.2% Yield Strength ksi (MPa) | Tensile Strength ksi (MPa) | % Reduction of Area | % Elongation | Hardness HRC | −75° F. (58° C.) CVN Impact Strength ft-lb (N-m) |
|---|---|---|---|---|---|
| 150–159 (1034–1096 MPa) | 197–202 (1358–1393 MPa) | 43–46 | 23–25 | 38–40 | 26–41 (35–56) |

By way of comparison, the conventional existing treatment which calls for solution annealing plus age hardening optimizes corrosion resistance to extremely severe sour brine environments containing elemental sulfur at temperatures to 400° F. (204° C.). The specification yield strength for conventional heat treatment is 120 ksi (827 MPa) minimum and 140 ksi (965 MPa) maximum.

Oil patch fabricators require higher strengths for flapper values in subsurface safety valves, packers and drilling equipment. Turbine manufacturers require high fracture engines, as expressed by tensile strength times elongation, greater than those exhibited by alloy 718 and high temperature strengths greater than those exhibited by alloy 725.

The instant process does not solution anneal all the precipitates in the as hot worked structure which helps control grain size. The 1200° F. (749° C.) heat treating step conducted after the aging step grows the gamma double prime precipitates which are formed during the 1400° F. (760° C.) aging treatment. After the entire process is completed a higher yield strength is obtained. Acceptable ductility and toughness are maintained along with resistance to hydrogen embrittlement as per the NACE Test Method 0177 Oil Patch hydrogen embrittlement test.

The aforementioned test, promulgated by the National Association of Corrosion Engineers, is a severe hydrogen embrittlement test in which the material being tested is galvanically coupled to steel in an oil patch type sour brine environment consisting of hydrogen sulfide saturated 5% sodium chloride with 0.5% acetic acid at 77° F. (25° C.) for a minimum period of thirty days.

Without being limited to a particular theory, it is surmised that annealing the alloy at about 1825° F. (996° C.) partially dissolves the delta phase ($Ni_3Nb$) which is generally present in hot worked material (although the instant process is specifically applicable to cold worked forms as well). This helps tailor the microstructure by controlling the grain size. Further, the presence of the intergranular delta phase is also thought to improve the crack growth resistance at elevated temperatures under static or dynamic loading. The double aging treatment at 1400° F. (760° C.) and 1200° F. (649° C.) following annealing is designed to produce a morphology and volume fraction of $Ni_3$ (Al,Ti)-type gamma prime and $Ni_3$(Nb,Al,Ti)-type double gamma prime precipitates to maximize the strength and ductility.

A number of tensile tests were conducted to evaluate the efficacy of the process.

Material for testing came from commercially produced 1-¼ inch to 2-¼ inch (3.18–5.7 cm) diameter INCONEL® alloy 725 hot rolled bar. The chemical compositions of evaluated heats are shown in Table 4.

TABLE 4

Chemical Composition of Evaluated Heats (wt. %)

| | HT5132LY | HT5143LY | HT7436LY |
|---|---|---|---|
| C | 0.005 | 0.005 | 0.006 |
| Mn | 0.07 | 0.13 | 0.07 |

TABLE 4-continued

Chemical Composition of Evaluated Heats (wt. %)

| | HT5132LY | HT5143LY | HT7436LY |
|---|---|---|---|
| Fe | 8.46 | 8.05 | 7.34 |
| S | 0.002 | 0.003 | 0.002 |
| Si | <0.01 | 0.02 | 0.05 |
| Cu | 0.01 | 0.01 | 0.03 |
| Ni* | 57.64 | 57.82 | 58.37 |
| Cr | 20.73 | 20.81 | 20.77 |
| Al | 0.11 | 0.16 | 0.21 |
| Ti | 1.55 | 1.5 | 1.53 |
| Co | <0.01 | 0.03 | 0.07 |
| Mo | 7.92 | 7.95 | 7.98 |
| Nb | 3.48 | 3.53 | 3.53 |
| P | 0.004 | 0.004 | 0.003 |
| B | 0.003 | 0.003 | 0.002 |

*Balance element, approximate composition

A hydrogen embrittlement test was conducted in accordance with the aforementioned NACE Test Method TM-0177 (A). Specimens were galvanically coupled to steel. A minimum test duration of 720 hours is required by the specification. In this case, the heat treated INCONEL alloy 725 specimens were removed from the environment after 725 hours of exposure.

DATA REVIEW:

Table 5 displays the mechanical properties for alloy 725 hot rolled bar, evaluated in various heat treated conditions. Material in these heat treated conditions exhibited excellent strength, ductility and toughness.

TABLE 5

Mechanical Properties alloy 725, Hot Rolled Bar

| | | Room Temperature Tensile | | | | | −75° F. CVN (−58° C.) | |
|---|---|---|---|---|---|---|---|---|
| Heat | Heat Treatment | YS ksi (MPa) | ULT ksi (MPa) | % RA | % EL | HRC | Impact Strength, ft-lb (N-m) | Lateral Expansion in (mm) |
| HT5132LY(22) | 1 | 168.6 (1162) | 212.3 (1464) | 40.8 | 22.5 | 42 | | |
| | 2 | 170.6 (1176) | 213.2 (1470) | 40.4 | 22.6 | 40 | | |
| | 3 | 167.0 (1151) | 211.4 (1458) | 39.9 | 21.9 | 41 | | |
| HT5132LY(24) | 4 | 172.1 (1187) | 215.8 (1488) | 35.6 | 20.6 | 42 | | |
| HT5143Y(41) | 5 | 145.3 (1002) | 203.5 (1403) | 35.1 | 22.9 | 39 | | |
| | 6 | 140.5 (969) | 201.4 (1389) | 35.0 | 23.7 | 36 | | |
| HT51432Y(13) | 1 | 158.1 (1090) | 198.9 (1371) | 43.3 | 25.2 | 39 | (39; 41) 29; 30 | (0.33) 0.013; 0.020 (0.51) |
| | 2 | 160.1 (1104) | 202.3 (1395) | 45.7 | 25.4 | 41 | 37; 37 (50; 50) | (0.41) 0.016; 0.019 (0.48) |
| | 3 | 150.6 (1038) | 193.2 (1322) | 44.4 | 24.6 | 39 | 26; 26 (35; 35) | (0.36) 0.014; 0.012 (0.30) |
| | 4 | 158.3 (1091) | 198.5 (1369) | 40.7 | 25.1 | 38 | 27; 29 (37; 39) | (0.36) 0.014; 0.017 (0.43) |
| | 5 | 137.7 (949) | 193.4 (1333) | 39.7 | 25.5 | 38 | 22; 20 (30; 27) | (0.43) 0.017; 0.012 (0.30) |
| | 6 | 133.0 (917) | 190.4 (1313) | 38.3 | 25.8 | 34 | 24; 23 (33; 31) | (0.30) 0.012; 0.013 (0.33) |
| | 7 | 158.5 (1093) | 197.1 (1359) | 43.8 | 24.7 | 40 | 26; 26 (35; 35) | (0.36) 0.014; 0.013 (0.33) |
| | 8 | 158.5 (1093) | 199.1 (1373) | 44.0 | 24.6 | 38 | 40; 32 (54; 43) | (0.53) 0.021; 0.048 (1.22) |
| | 9 | 156.2 (1077) | 197.5 (1362) | 42.7 | 25.1 | 39 | 30; 33 (41; 45) | (0.41) 0.016; 0.010 (0.25) |
| | 10 | 157.7 (1087) | 195.0 (1344) | 42.2 | 24.8 | 41 | 39; 42 (53; 57) | (0.43) 0.017; 0.017 (0.43) |
| HT7436LY | 11 | 151.4 (1043) | 201.6 (1390) | 45.1 | 23.7 | | 32.5 (44.1) | 0.018 (0.46) |
| | 12 | 151.0 (1041) | 202.2 (1394) | 45.4 | 24.7 | | 36.5 (49.50) | 0.017 (0.43) |
| | 13 | 151.7 (1045) | 201.9 (1392) | 44.1 | 23.3 | | 36.0 (48.8) | 0.023 (0.58) |

TABLE 5-continued

Mechanical Properties alloy 725, Hot Rolled Bar

| Heat | Heat Treatment | Room Temperature Tensile YS ksi (MPa) | ULT ksi (MPa) | % RA | % EL | HRC | −75° F. CVN (−58° C.) Impact Strength, ft-lb (N-m) | Lateral Expansion in (mm) |
|---|---|---|---|---|---|---|---|---|
| | 14 | 151.4 (1043) | 201.7 (1391) | 45.7 | 24.4 | | 39.5 (53.6) | 0.030 (0.76) |
| | 15 | 150.5 (1037) | 200.9 (1385) | 44.1 | 23.9 | | 41.0 (53.6) | 0.030 (0.76) |

Heat Treated Condition:
1. 1825° F. (996° C.)/1 h/AC + 1400° F. (760° C.)/10 h, FC at 50° F. (28° C.)/h to 1200° F. (649° C.)/8 h/AC
2. 1825° F. (996° C.)/1 h/AC + 1400° F. (760° C.)/6 h, FC at 50° F. (28° C.)/h to 1200° F. (649° C.)/12 h/AC
3. 1825° F. (996° C.)/1 h/AC + 1400° F. (760° C.)/14 h, FC at 50° F. (28° C.)/h to 1200° F. (649° C.)/4 h/AC
4. 1825° F. (996° C.)/1 h/AC + 1400° F. (760° C.)/10 h, FC at 50° F. (28° C.)/h to 1200° F. (649° C.)/8 h/AC
5. 1825° F. (996° C.)/1 h/AC + 1550° F. (843° C.)/3 h, AC + 1400° F./8 h, FC at 50° F/h to 1150° F. (621° C.)/8 h/AC
6. 1850° F. (1010° C.)/1 h/AC + 1400° F. (760° C.)/3 h, FC at 50° F. (28° C.)/h to 1200° F. (649° C.)/8 h/AC
7. 1825° F. (996° C.)/2 h/AC + 1400° F. (760° C.)/6 h, FC at 50° F. (28° C.)/h to 1200° F. (649° C.)/8 h/AC
8. 1825° F. (996° C.)/2 h/AC + 1400° F. (760° C.)/6 h, FC at 50° F. (28° C.)/h to 1200° F. (649° C.)/6 h/AC
9. 1825° F. (996° C.)/2 h/AC + 1400° F. (760° C.)/6 h, FC at 50° F. (28° C.)/h to 1200° F. (649° C.)/12 h/AC
10. 1825° F. (996° C.)/1 h/AC + 1400° F. (760° C.)/6 h, FC at 50° F. (28° C.)/h to 1200° F. (649° C.)/6/AC
11. 1825° F. (996° C.)/1.00 h/AC + 1400° F. (760° C.)/6 h, FC at 50° F. (28° C.)/h to 1200° F. (649° C.)/6 h/AC
12. 1825° F. (996° C.)/1.25 h/AC + 1400° F. (760° C.)/6 h, FC at 50° F. (28° C.)/h to 1200° F. (649° C.)/6 h/AC
13. 1825° F. (996° C.)/1.50 h/AC + 1400° F. (760° C.)/6 h, FC at 50° F. (28° C.)/h to 1200° F. (649° C.)/6 h/AC
14. 1825° F. (996° C.)/2.00 h/AC + 1400° F. (760° C.)/6 h, FC at 50° F. (28° C.)/h to 1200° F. (649° C.)/6 h/AC
15. 1825° F. (996° C.)/4.00 h/AC + 1400° F. (760° C.)/6 h, FC at 50° F. (28° C.)/h to 1200° F. (649° C.)/6 h/AC
(FC = Furnace Cool, AC = Air Cooling, h = hour)
(VN = Charpy - V-Notch, HRC = Hardness Rockwell C, RA = Reduction in Area, EL = Elongation)

Samples 4, 8, 9 and 10 were subjected to and passed the NACE Test Method 0177 (A) oil patch hydrogen embrittlement test. After 725 hours of exposure to the sour brine environment, there was no cracking of duplicate specimens coupled to steel. Results are shown in Table 6.

TABLE 6

TM0177 (A) Hydrogen Embrittlement Test* Results

| Heat Treated Condition | Test Duration, hours | Comment |
|---|---|---|
| 4 | 725 | Passed, no cracking |
| 8 | 725 | Passed, no cracking |
| 9 | 725 | Passed, no cracking |
| 10 | 725 | Passed, no cracking |

*Tested galvanically coupled to steel

An additional series of experimental heat treatment tests were undertaken on a forged ring made from alloy 725.

A 6 inch (15.2 cm) diameter forging stock round of heat HT6094LY (alloy 725) was forged to a ring (13 inch outer diameter, 8 inch inner diameter, and 3 inch height). The chemical composition of heat HT6094LY is given in Table 7.

TABLE 7

Chemical Composition of Heat HT6094LY

| Ni | Cr | Fe | Mo | Nb | Ti | AI | C |
|---|---|---|---|---|---|---|---|
| 58.08 | 20.73 | 7.71 | 7.99 | 3.47 | 1.52 | 0.21 | 0.010 |

The forged ring was subjected to annealing at 1800° F. (982° C.), 1825° F. (996° C.), and 1850° F. (1010° C.) for one hour. These annealing conditions provided fully recrystallized microstructure with grain sizes of ASTM #7, 6, and 5, respectively. The material annealed at 1825° F. (996° C.) was subjected to three aging conditions coded A, B, and C. The aging conditions are given below:

A=1325° F. (718° C.)/8h, Furnace Cool at 100° F. (56° C.)/h to 1150° F. (621° C.), Hold at 1150° F. (621° C.)/8h, Air Cool B=1400° F. (760° C.)/10h, Furnace Cool at 100° F. (56° C.)/h to 1200° F. (649° C.), Hold at 1200° F. (649° C.)/8h, Air Cool C=1550° F. (843° C.)/3h Air Cool +1325° F. (718° C.)/8h, Furnace Cool at 100° F. (56° C)/h to 1150° F. (625° C), Hold at 1150° F. (625° C.)/8h, Air Cool.

Code B's heat treatment resulted in the best combination of properties for room temperature tensile, 1200° F. (649° C.) tensile, and 1200° F.-110 ksi (649° C.-758 MPa) stress rupture (Tables 8, 9 and 10). Therefore, code B heat treatment was selected to evaluate long term stability and crack growth resistance. The tensile properties reported are the averages of duplicate tests.

TABLE 8

Room Temperature Tensile Properties

| Heat Treatment | Yield Strength ksi (MPa) | Tensile Strength ksi (MPa) | % Elongation | Reduction of Area |
|---|---|---|---|---|
| A | 132(910) | 190(1310) | 27 | 53 |
| B | 150(1034) | 198(1365) | 21 | 41 |
| C | 141(972) | 195(1344) | 21 | 36 |

TABLE 9

High Temperature (1200° F.) Tense Properties

| Heat Treatment | Yield Strength ksi (MPa) | Tensile Strength ksi (MPa) | % Elongation | Reduction of Area |
|---|---|---|---|---|
| A | 111(765) | 160(1103) | 36 | 59 |
| B | 127(876) | 171(1179) | 27 | 43 |
| C | 120(827) | 168(1158) | 31 | 54 |

TABLE 10

Combination Bar Stress Rupture Tests at 1200° F.-110 ksi

| Heat Treatment | Rupture Life, h | % Elongation | Reduction in Area |
|---|---|---|---|
| A | 35.6 | 14.7 | 29.8 |
| | 53.3 | 24 | 22.2 |
| B | 45.2 | 43.5 | 49 |
| | 31.8 | 23.6 | 29.2 |
| C | 11.8 | 40.8 | 52 |
| | 12.4 | 28.6 | 32.9 |

Table 11 shows room temperature tensile properties of the material exposed at 1100° F. (593° C.) up to 5000 h. The initial 500 h exposure increased the room temperature yield strength to 160 ksi (1103 MPa) and thereafter it remained constant up to a total exposure time of 5000 h. Room temperature elongation and reduction of area did not change with exposure. The initial 500 h exposure at 1100° F. (593° C.) increased the 1200° F. (649° C.) yield strength to 134 ksi (924 MPa) (Table 12) and thereafter it remained constant up to a total exposure time of 7500 h. High temperature elongation essentially remained constant with exposure except 1000 h exposure which had low elongation of 16%.

TABLE 11

Room Temperature Tensile Properties of As-produced (Code B heat treated) and 1100° F. (593° C.) Exposed Material

| Exposure Condition | Yield Strength ksi (MPa) | Tensile Strength ksi (MPa) | % Elongation | Reduction of Area |
|---|---|---|---|---|
| As-produced | 150(1034) | 198(1365) | 21 | 41 |
| 500 hours | 161(1110) | 205(1413) | 20 | 44 |
| 1000 hours | 158(1089) | 202(1993) | 21 | 44 |
| 5000 hours | 159(1096) | 203(1399) | 18 | 34 |

TABLE 12

High Temperature (1200° F.) Tensile Properties of As-produced (Code B heat treated) and 1100° F. (598° C.) Exposed Material

| Exposure Condition | Yield Strength ksi (MPa) | Tensile Strength ksi (MPa) | % Elongation | Reduction of Area |
|---|---|---|---|---|
| As-produced | 127(876) | 171(1179) | 27 | 43 |
| 500 hours | 134(924) | 175(931) | 29 | 50 |
| 1000 hours | 134(924) | 176(1213) | 16 | 23 |
| 2500 hours | 133(917) | 176(931) | 24 | 39 |
| 7500 hours | 134(924) | 176(1213) | 27 | 44 |

Figure 2:
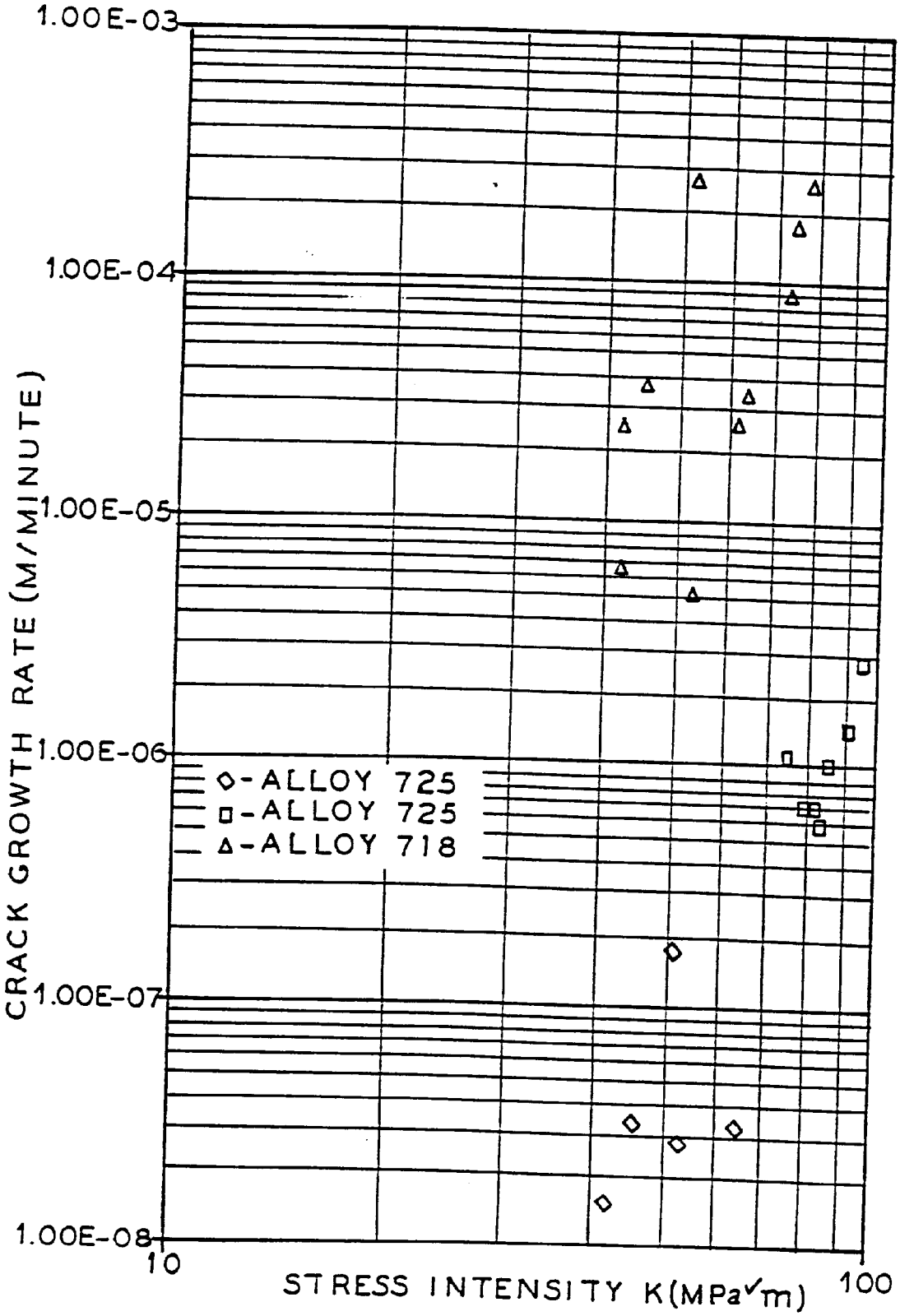
FIG. 2 compares static crack growth data for alloy 725 and alloy 718 at 649° C. (1200° F.)

FIGS. 1 and 2 compare the crack growth data of alloys 725 and 718 at 1000° F. (538° C.) and 1200° F. (649° C.) in air. Crack growth resistance of alloy 725 when processed in accordance with the instant heat treatment is at least an order of magnitude better than standard treated alloy 718.

The heat treatment of annealing the worked alloy at about 1825° F. (996° C.)/1.0 h air cooling+about 1400° F. (760° C.)/10 h, furnace cooling at about 100° F. (56° C.)/h to 1200° F. (649° C.), holding at about 1200° F. (649° C.)/8 h, and air cooling provided the best combination of properties for room temperature tensile, high temperature tensile, and stress rupture. The material subjected to this heat treatment demonstrated excellent long term thermal stability at 1100° F. (593° C.). Further, the static crack growth resistance of alloy 725 subjected to this heat treatment was at least an order of magnitude better than alloy 718 at 1000° F. (538° C.) and 1200° F. (649° C.).

Moreover, the length of the time at temperature during annealing and prior to age-hardening has significant impact on the mechanical properties of alloy 725. Annealing for about 1.5 or 2 hours and longer has been found to improve low temperature properties as demonstrated by the heat treating conditions 11–15 of heat HT7436LY. This data is set forth graphically in FIG. 3 which indicates that superior low temperature properties are exhibited when alloy 725 is annealed for over 1 hour. In particular, the data shows a significant increase in low temperature ductility (lateral expansion) for material annealed for 1.5 hours at 1825° F. prior to age-hardening compared to material annealed for only 1.0 hour at 1825° F. prior to age-hardening.

In accordance with the provisions of the statute, the specification illustrates and describes specific embodiments of the invention. Those skilled in the art will understand that changes may be made in the form of the invention covered by the claims; and that certain features of the invention may sometimes be used to advantage without a corresponding use of the other features.

We claim:

1. A process for heat treating an age hardenable nickel-base alloy to provide a yield strength in excess of about 145 ksi (1000 MPa) and improved low temperature ductility, the method comprising:

(a) providing a worked material consisting of a Ni-base alloy consisting essentially of in % by weight: 55–63 Ni, 19–22.5 Cr, 7–9.5 Mo, 2.75–4 Nb, 1–1.7 Ti, 0.35 max. Al, 0.03 max. C, 0.35 max. Mn, 0.2 max. Si, 0.15 max. P, 0.01 max. S, trace amount of commercial impurities, and remainder Fe;

(b) annealing the worked material at about 1825° F. (996° C.)±25° F. (14° C.) for at least about 1.5 hours to provide an annealed material; and (c) age hardening the annealed material by heating the material at about 1400° F. (760° C.)±50° F. (28° C.) for about 3.0 to 10.5 hours;

furnace cooling the material to about 1200° F. (649° C.); and heating the material at about 1200° F. (649° C.)±50° F. (28° C.) for about 4.0 to 12.5 hours to provide an age hardened material.

2. The process according to claim 1 including furnace cooling the heated material about 50° F. (28° C.)±25° F. (14° C.) per hour to about 100° F. (56° C.)±25° F. (14° C.) per hour.

3. The process of claim 1 wherein step b) comprises annealing for at least about 2 hours.

4. The process of claim 1 wherein step b) comprises annealing for about 1.5 to 4 hours.

5. The process according to claim 1 wherein said step b) comprises annealing the material for about 2 to 4 hours.

6. The process according to claim 1 including forming gamma double prime particles in the Ni-base alloy during the age hardening step (c).

7. The process according to claim 1 wherein after the age hardening step (c), the room temperature yield strength of the age hardened material is about 150–159 ksi (1034–1393 MPa).

8. The process according to claim 1 wherein the Ni-base alloy after the age hardening step (c) has a low temperature Charpy-V-notch impact strength at −75° F. (−58° C.) equal to or greater than about 26 ft-lbs (35 N-m).

9. The process of claim 1 wherein the Ni-base alloy provided in step (a) consists essentially of, in % by weight: 55.0–59.0 Ni, 19.0–22.5 Cr, 7.0–9.5 Mo, 2.75–4.0 Nb, 1.0–1.7 Ti, 0.35 max. Al, 0.03 max. C, 0.35 max. Mn, 0.20 max. Si, 0.015 max. P, 0.010 max. S, trace amount of commercial impurities, and balance Fe.

10. The process of claim 1 wherein the Ni-base alloy provided in step (a) consists essentially of, in % by weight: 57.0–63.0 Ni, 19.0–22.0 Cr, 7.0–9.5 Mo, 2.75–4.0 Nb, 1.0–1.6 Ti, 0.35 max. Al, 0.03 max. C, 0.20 max. Mn, 0.20 max. Si, 0.015 max. P, 0.010 max. S, trace amount of commercial impurities, and balance Fe.

* * * * *